US011439284B2

(12) United States Patent
Brunner

(10) Patent No.: US 11,439,284 B2
(45) Date of Patent: Sep. 13, 2022

(54) AGITATOR AND NOZZLE ASSEMBLY

(71) Applicant: SharkNinja Operating, LLC, Needham, MA (US)

(72) Inventor: Charles S. Brunner, Stockton, NJ (US)

(73) Assignee: SharkNinja Operating LLC, Needham, MA (US)

( * ) Notice: Subject to any disclaimer, the term of this patent is extended or adjusted under 35 U.S.C. 154(b) by 147 days.

(21) Appl. No.: 16/818,110

(22) Filed: Mar. 13, 2020

(65) Prior Publication Data

US 2020/0288929 A1 Sep. 17, 2020

Related U.S. Application Data

(60) Provisional application No. 62/818,298, filed on Mar. 14, 2019.

(51) Int. Cl.

| | |
|---|---|
| ***A47L 9/04*** | (2006.01) |
| ***A47L 9/24*** | (2006.01) |
| ***A47L 9/32*** | (2006.01) |

(52) U.S. Cl.

CPC ..... *A47L 9/0466* (2013.01); *A47L 9/0411* (2013.01); *A47L 9/248* (2013.01); *A47L 9/32* (2013.01)

(58) Field of Classification Search

CPC ..... A47L 9/0466; A47L 9/0411; A47L 9/248; A47L 9/32; A47L 9/0427; A47L 9/0477; A47L 9/0488; A47L 9/0072; A47L 5/30

(Continued)

(56) References Cited

U.S. PATENT DOCUMENTS 2,785,432 A * 3/1957 Rockwell ..... A47L 9/02 15/375
6,032,327 A * 3/2000 Oka ..... A47L 5/14 15/346

(Continued)

FOREIGN PATENT DOCUMENTS

DE 202016102469 U1 8/2017
JP 2002233480 A * 8/2002

(Continued)

OTHER PUBLICATIONS

English Translation of JP 2002/233480 (Year: 2002).*

(Continued)

*Primary Examiner* — Andrew A Horton
(74) *Attorney, Agent, or Firm* — Grossman Tucker Perreault & Pfleger, PLLC

(57) ABSTRACT

A vacuum cleaner system includes an agitator and nozzle assembly having an agitator configured to rotate about a pivot axis and a suction tube. The agitator includes an agitator body having an agitator suction inlet and defining a suction tube chamber. The suction tube chamber extends along at least a portion of the pivot axis and includes a suction tube opening disposed at one end thereof. The suction tube is received through the suction tube opening and partially into the suction tube chamber, and includes a suction tube inlet. The agitator is configured to rotate about the pivot axis relative to suction tube such that the agitator suction inlet and the suction tube inlet partially overlap and an air flow path is established which extends through agitator suction inlet, into suction tube chamber, through suction tube inlet, and into the suction tube.

17 Claims, 14 Drawing Sheets

(58) Field of Classification Search
USPC ..... 15/375, 404
See application file for complete search history.

(56) References Cited

U.S. PATENT DOCUMENTS

| | | | | |
|---|---|---|---|---|
| 8,898,859 | B2 * | 12/2014 | Song | A47L 9/0483 15/382 |
| 2005/0160555 | A1 | 7/2005 | Mayes | |
| 2006/0042040 | A1 * | 3/2006 | Dever | A47L 9/0477 15/383 |

FOREIGN PATENT DOCUMENTS

| | | | | |
|---|---|---|---|---|
| JP | 2002233480 | A | | 8/2002 |
| JP | 2005046230 | A | | 2/2005 |
| KR | 20060038798 | A | | 5/2006 |
| KR | 20100088360 | A | * | 8/2010 |
| KR | 20100088360 | A | | 8/2010 |

OTHER PUBLICATIONS

English Translation of KR 2010/0088360 (Year: 2010).*
International Search Report and Written Opinion dated Jun. 2, 2020, received in PCT Application No. PCT/US20/22629, 11 pgs.

* cited by examiner

AGITATOR AND NOZZLE ASSEMBLY

CROSS REFERENCE TO RELATED APPLICATIONS

The present application claims the benefit of U.S. Provisional Patent Application Ser. No. 62/818,298 filed Mar. 14, 2019, which is fully incorporated herein by reference.

TECHNICAL FIELD

The present disclosure is generally directed to surface treatment apparatuses and more specifically to an agitator and nozzle assembly.

BACKGROUND INFORMATION

Surface treatment apparatuses may include vacuum cleaners configured to suction debris from a surface (e.g., a floor). The vacuum cleaner may include a surface cleaning head having one or more brush rolls configured to agitate a surface (e.g., a carpet) to urge debris into an airflow stream generated by a suction motor of the vacuum cleaner. The debris within the airflow stream may then be deposited in a debris collector (e.g., a bag) for later disposal. In some applications, the suction motor and/or agitator is powered by one or more batteries (e.g., rechargeable batteries).

BRIEF DESCRIPTION OF THE DRAWINGS

These and other features and advantages will be better understood by reading the following detailed description, taken together with the drawings, wherein.

DETAILED DESCRIPTION

By way of a brief overview, the present disclosure may feature a vacuum cleaner system that includes an agitator and nozzle assembly having an agitator configured to rotate about a pivot axis and a suction tube. In some example, the agitator and nozzle assembly may be referred to as an inverted agitator and nozzle assembly. The agitator includes an agitator body having an agitator suction inlet and defining a suction tube chamber. The suction tube chamber extends along at least a portion of the pivot axis and includes a suction tube opening disposed at one end thereof. The suction tube is received through the suction tube opening and partially into the suction tube chamber, and includes a suction tube inlet. The agitator is configured to rotate about the pivot axis relative to suction tube such that the agitator suction inlet and the suction tube inlet partially overlap and an air flow path is established which extends through agitator suction inlet, into suction tube chamber, through suction tube inlet, and into the suction tube.

Figure 1:
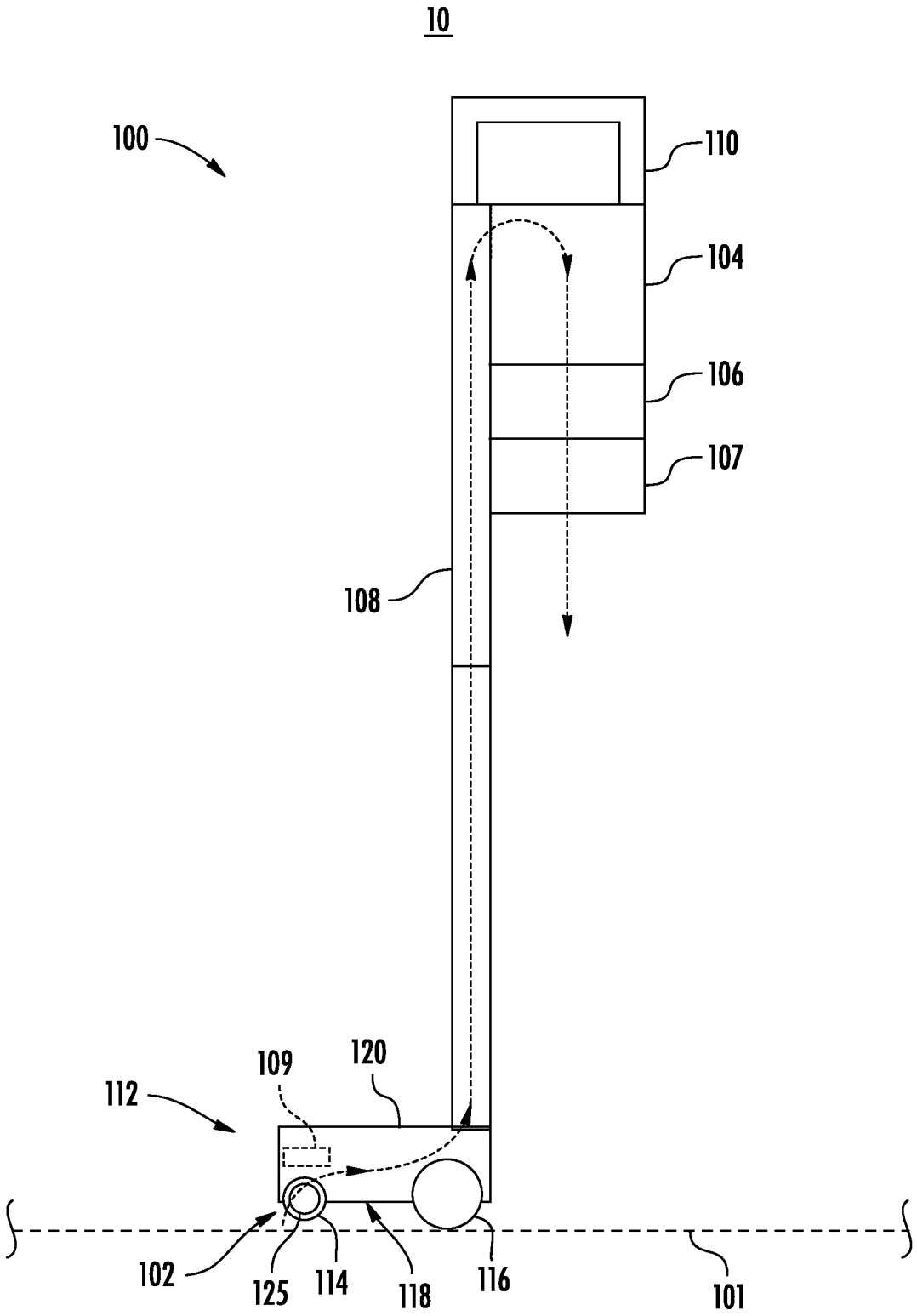
FIG. 1 shows a schematic view of vacuum cleaner including an agitator and nozzle assembly, consistent with embodiments of the present disclosure.
Figure 2:
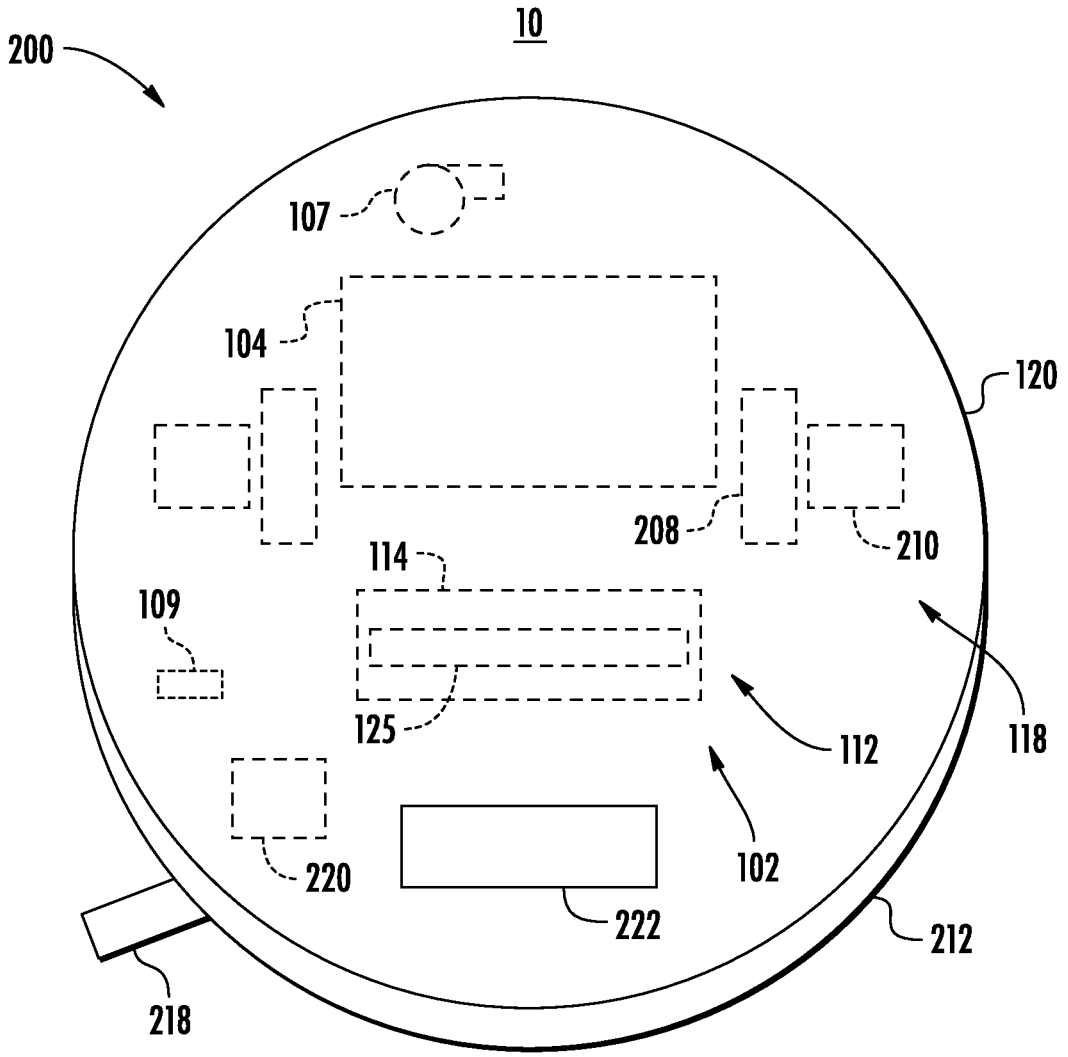
FIG. 2 shows a schematic view of another embodiment of a vacuum cleaner including an agitator and nozzle assembly, consistent with embodiments of the present disclosure.

FIGS. 1 and 2 show exemplary embodiments of a vacuum cleaner 10, each including an agitator and nozzle assembly 102 consistent with one or more embodiments of the present disclosure. As explained herein, the agitator and nozzle assembly 102 may be configured to agitate debris from a surface 101 to be cleaned and to entrain the debris in a dirty air flow. The agitator and nozzle assembly 102 may increase the air velocity at the surface 101 to be cleaned while minimizing the power required to drive the air velocity and reducing friction between the surface 101 to be cleaned and the agitator. The term vacuum cleaner 10 is intended to refer to any type of vacuum cleaner including, but not limited to, hand-operated vacuum cleaners 100 (FIG. 1) and robot vacuum cleaners 200 (FIG. 2).

Turning now to FIG. 1, an exemplary embodiment of a hand-operated vacuum cleaner 100 is generally illustrated. The hand-operated vacuum cleaner 100 may include any vacuum cleaner known to those skilled in the art including, but not limited to, an "all in the head" type vacuum, upright vacuum cleaners, canister vacuum cleaners, stick vacuum cleaners, and central vacuum cleaners. It should be understood that the hand-operated vacuum cleaner 100 shown is for exemplary purposes only and that a hand-operated vacuum cleaner 100 may not include all of the features shown in FIG. 1 and/or may include additional features not shown in FIG. 1. For exemplary purposes only, a hand-operated vacuum cleaner 100, FIG. 1, may include a debris compartment 104, one or more filters 106, one or more suction motors 107, a fluid conduit 108, a handle 110, a vacuum housing 120, and a nozzle and/or surface treatment head 112. The nozzle 112 may include one or more wheels 116 and one or more agitator and nozzle assemblies 102. The agitator and nozzle assembly 102 may include one or more rotatable agitators 114 (also referred to as a primary agitator and/or an inverted agitator) configured to rotate about one or more suction tubes 125. The agitators 114 may be driven by one or more motors 109 (and optionally drivetrains) disposed within the hand-operated vacuum cleaner 100 (e.g., the vacuum housing 120). By way of a non-limiting example, the agitator 114 may include a rotatable bush bar having a plurality of bristles. The surface treatment head 112 may optionally include a power source (such as one or more batteries) and/or a power cord. The power source may be mounted at the surface treatment head 112 or may be mounted elsewhere on the hand-operated vacuum cleaner 100.

FIG. 2 shows a schematic view of an example of a robotic vacuum cleaner 200. It should be understood that the robotic vacuum cleaner 200 shown is for exemplary purposes only and that a robotic vacuum cleaner 200 may not include all of the features shown in FIG. 2 and/or may include additional features not shown in FIG. 2. The robotic vacuum cleaner 200 may include a vacuum housing 120 defining a nozzle 112, a debris compartment 104, a suction motor 107, and one or more agitator and nozzle assemblies 102. The suction motor 107 causes debris to be suctioned through the agitator and nozzle assemblies 102 and deposited into the debris compartment 104 for later disposal. The agitator and nozzle assembly 102 may include one or more rotatable agitators 114 configured to rotate about one or more suction tubes 125. The agitator 114 may be driven by one or more motors 109 disposed within the robotic vacuum cleaner 200. By way of a non-limiting example, the agitator 114 may include a rotatable bush bar having a plurality of bristles.

The robotic vacuum cleaner 200 includes a plurality of wheels 208 coupled to one or more drive motors 210. In some example, each wheel 208 may generally be described as being independently driven. The robotic vacuum cleaner 200 can be steered by adjusting the rotational speed of one of the plurality of wheels 208 relative to the other of the plurality of wheels 208. One or more side brushes 218 can be positioned such that a portion of the side brush 218 extends at least to (e.g., beyond) the perimeter defined by a vacuum housing 120 of the robotic vacuum cleaner 200. The side brush 218 can be configured to urge debris in a direction of the air inlet such that debris located beyond the perimeter of the vacuum housing 120 can be collected. For example, the side brush 218 can be configured to rotate in response to activation of a side brush motor 220.

A user interface 222 can be provided to allow a user to control the robotic vacuum cleaner 200. For example, the user interface 222 may include one or more push buttons that correspond to one or more features of the robotic vacuum cleaner 200. The robotic vacuum cleaner 200 may optionally include a power source (such as one or more batteries) and/or one or more displaceable bumpers 212 disposed along a portion of the perimeter defined by a vacuum housing 120 of the robotic vacuum cleaner 200. The displaceable bumper 212 may displaced in response to engaging (e.g., contacting) at least a portion of an obstacle that is spaced apart from the surface to be cleaned. Therefore, the robotic vacuum cleaner 200 may avoid becoming trapped between the obstacle and the surface to be cleaned.

Figure 3:
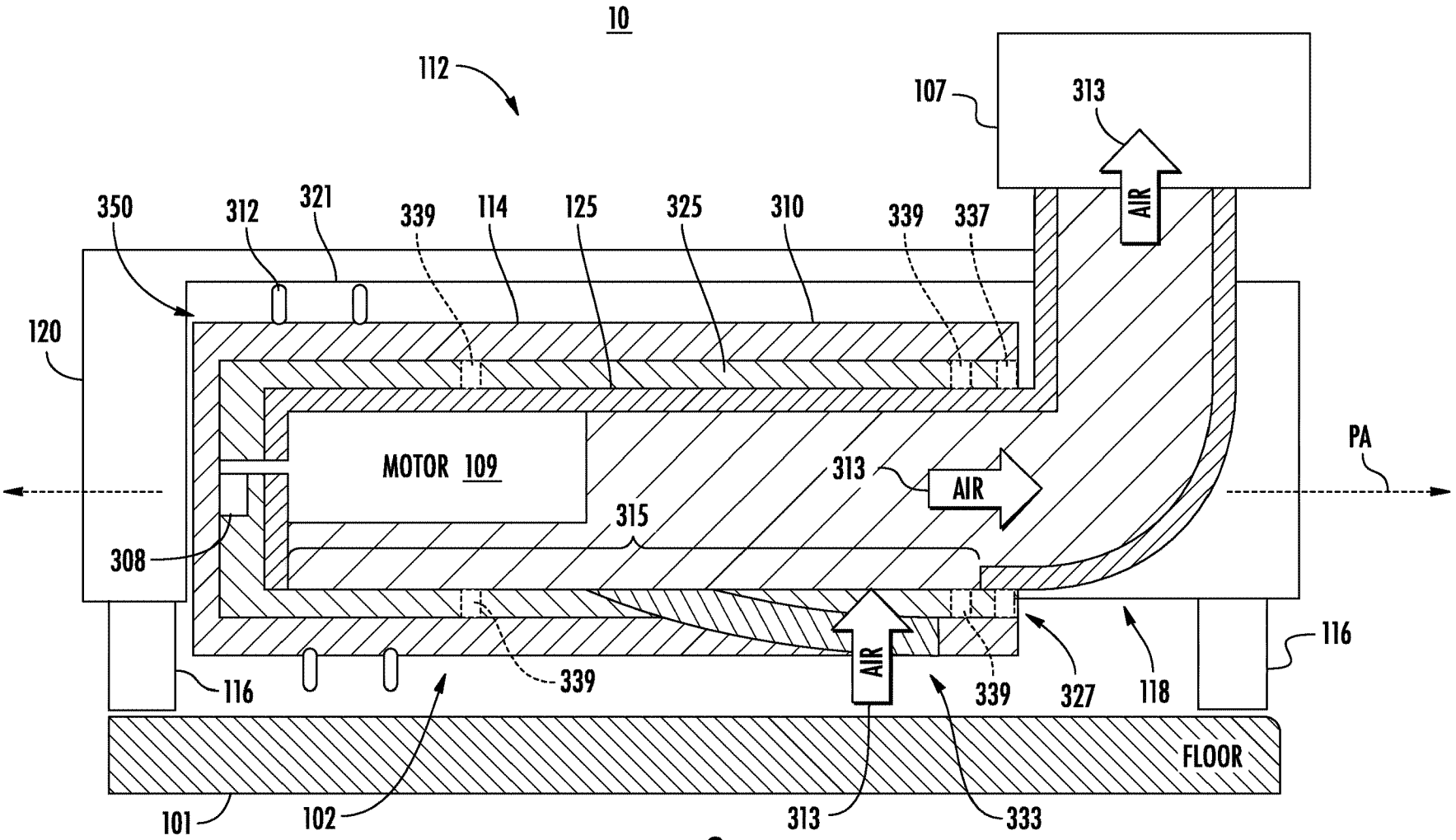
FIG. 3 shows a schematic view of one embodiment of the agitator and nozzle assembly FIGS. 1 and 2 consistent with the present disclosure.

Turning now to FIG. 3, a close-up perspective view of one embodiment of an agitator and nozzle assembly 102 of a vacuum cleaner 10 consistent with the present disclosure is generally illustrated. As used herein, the term vacuum cleaner 10 is intended to refer to any type of vacuum cleaner including, but not limited to, hand-operated vacuum cleaners 100 and robot vacuum cleaners 200. As such, while the agitator and nozzle assembly 102 is shown in combination with a nozzle 112 of a hand-operated vacuum cleaner 100, it should be appreciated that the agitator and nozzle assembly 102 may also be included in any vacuum cleaner 10 including, but not limited to, a robot vacuum cleaner 200.

The agitator and nozzle assembly 102 may include one or more rotatable agitators 114 configured to rotate about one or more suction tubes 125. The suction tube 125 is configured to be fluidly coupled to one or more suction motors 107 and may include one or more suction tube inlets 315. For example, the suction tube 125 may be directly fluidly coupled to one or more filters 106 (FIGS. 1 and 2) such that a portion a dirty air flow path 313 extends from the suction tube inlet 315 of the suction tube 125, through the suction tube 125, through the filters 106 and to the suction motor 107.

The agitator 114 may be rotatably coupled to the housing 120 such that a least a portion of the agitator 114 extends beyond the bottom surface 118 of the housing 120 and may be configured to contact a surface 101 to be cleaned (e.g. a floor and/or carpet). One or more motors 109 may be directly or indirectly coupled (e.g., using a drivetrain 308 such as gears, belts, or the like) to the agitator 114 to rotate the agitator 114 relative to housing 120 of the nozzle 112 about a pivot axis PA in any manner known to those skilled in the art. The agitator 114 may include an agitator body 310 and one or more agitating features 312 such as, but not limited to, bristles (e.g., continuous and/or discontinuous rows of bristles and/or tufts of bristles), felt, flexible strips (e.g., rubber strips or the like), flexible and/or rigid sidewalls, and/or the like). The agitator body 310 may be referred to as an elongated agitator body 310 because the length of the agitator body 310 along the pivot axis PA may be greater than the width or height (e.g., the diameter) of the agitator body 310. For example, the length of the agitator body 310 along the pivot axis PA may be at least twice the width or height (e.g., the diameter) of the agitator body 310, or for example, at least four times the width or height (e.g., the diameter) of the agitator body 310, including all ranges and values therein.

The agitator 114 may rotate at least partially within an agitator chamber 321, which may be defined by the nozzle 112 and/or housing 120. The agitator 114 (e.g., the agitator body 310) defines a suction tube chamber 325 which extends along at least a portion of the elongated agitator body 310 (e.g., along at least a portion of the pivot axis PA). According to one embodiment, the suction tube chamber 325 is substantially coaxial with the pivot axis PA. Alternatively, the suction tube chamber 325 may not be coaxial with the pivot axis PA.

The suction tube chamber 325 includes a suction tube opening 327 configured to receive at least a portion of a suction tube 125. As may therefore be appreciated, the agitator 114 may rotate relative to the nozzle 112 (and/or housing 120) around at least a portion of the suction tube 125, and the suction tube 125 may remain substantially stationary with respect to the nozzle 112 (and/or housing 120). Optionally, one or more seals 337 (e.g., o-rings or the like) may be provided between the agitator 114 (e.g., within the inside surface of the suction tube chamber 325) and the suction tube 125 (e.g., an outer surface of the suction tube 125) to generally prevent airflow from entering into the suction tube chamber 325. The agitator 114 (e.g., the agitator body 310) may further include one or more agitator suction inlets 333 (which may include, for example, one or more helical slots, linear slots, and/or series of holes). The dirty air flow path 313 may thus extend from the agitator suction inlet 333, into at least a portion of the suction tube chamber 325, through the suction tube inlet 315 of the suction tube 125, through the suction tube 125, through the filters 106, and to the suction motor 107.

According to one aspect, one or more of the suction tube inlets 315 may be configured to generally face toward the surface 101 to be cleaned and/or may be aligned generally facing the bottom surface 118 of the nozzle 112 and/or housing 120. In some embodiments, at least one suction tube inlet 315 may be aligned substantially normal to the floor 101 and/or may be aligned at an angle within the range of +/−70 degrees from normal to the floor 101 and/or bottom surface 118 (i.e., within the range of 20 degrees to 160 degrees from the floor 101 and/or bottom surface 118) generally in the direction of the forward and backward movement of the vacuum (i.e., generally traverse to the pivot axis PA). It should be appreciated, however, that these angles/orientations are merely exemplary embodiments and that the present disclosure is not limited to these particular angles/orientations unless specifically claimed as such. For example, it is possible that one or more of the suction tube inlets 315 may be aligned facing the top of the nozzle 112 and/or body 120, a forward portion of the nozzle 112 and/or body 120, a left side of the nozzle 112 and/or body 120, a right side of the nozzle 112 and/or body 120, and/or a rearward portion of the nozzle 112 and/or body 120.

One or more of the suction tube inlets 315 may form a slot, e.g., an elongated slot. For example, an elongated slot may include a slot having a length extending generally along the pivot axis PA which is greater than or equal to 20% of the length of the agitator 114, for example, greater than or equal to 30% of the length of the agitator 114, greater than or equal to 40% of the length of the agitator 114, greater than or equal to 50% of the length of the agitator 114, greater than or equal to 60% of the length of the agitator 114, greater than or equal to 70% of the length of the agitator 114, greater than or equal to 80% of the length of the agitator 114, greater than or equal to 80% of the length of the agitator 114, including all ranges and values therein. The maximum length of the elongated slot may be less than the length of the agitator 114. The width of the slot may be less than the length of the slot.

A suction tube inlet 315 may form a slot and/or channel in the suction tube 125. For example, one or more of the suction tube inlets 315 may have a generally linear configuration. The linear suction tube inlet 315 may extend generally parallel to the pivot axis PA and/or a suction tube inlet 315 may extend nonparallel to the pivot axis PA (e.g., but not limited to, a chevron-like pattern). One or more of the suction tube inlets 315 may have an arcuate configuration (e.g., a curvilinear pattern and/or a generally helical pattern).

As the agitator 114 rotates about the pivot axis PA relative to the suction tube 125, the agitator suction inlets 333 may align with one or more of the suction tube inlets 315. For example, rather than air being directed around the outside of the agitator 114 as in the case of a conventional nozzle, the suction tube inlet 315 and the agitator suction inlet 333 may be aligned such that a focused suction path 313 is orientated in a desired inlet angle (i.e., the angle of the agitator suction inlet 333) relative to the floor 101 and/or bottom surface 118, and the air path 313 extends through the agitator suction inlet 333, into at least a portion of the suction tube chamber 325, through the suction tube inlet 315 of the suction tube 125, through the suction tube 125, through the filters 106, and to the suction motor 107. In this sense, the agitator and nozzle assembly 102 may be referred to as an inverted agitator and nozzle assembly 102.

Figure 4:
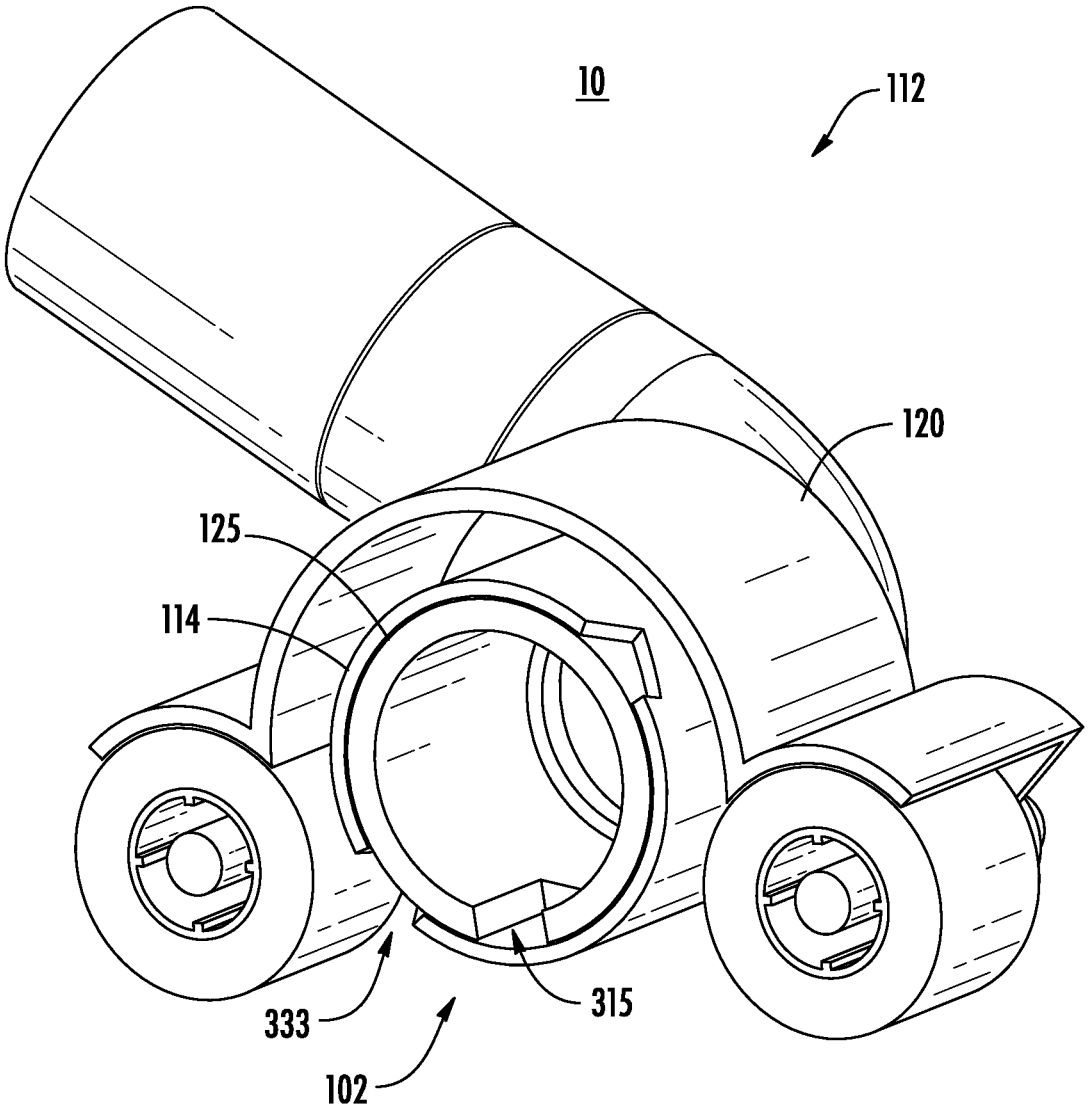
FIG. 4 shows a cross-sectional view of one embodiment of an agitator and nozzle assembly with zero overlap of the suction tube inlet and the agitator suction inlet at this position along the length of the agitator.
Figure 5:
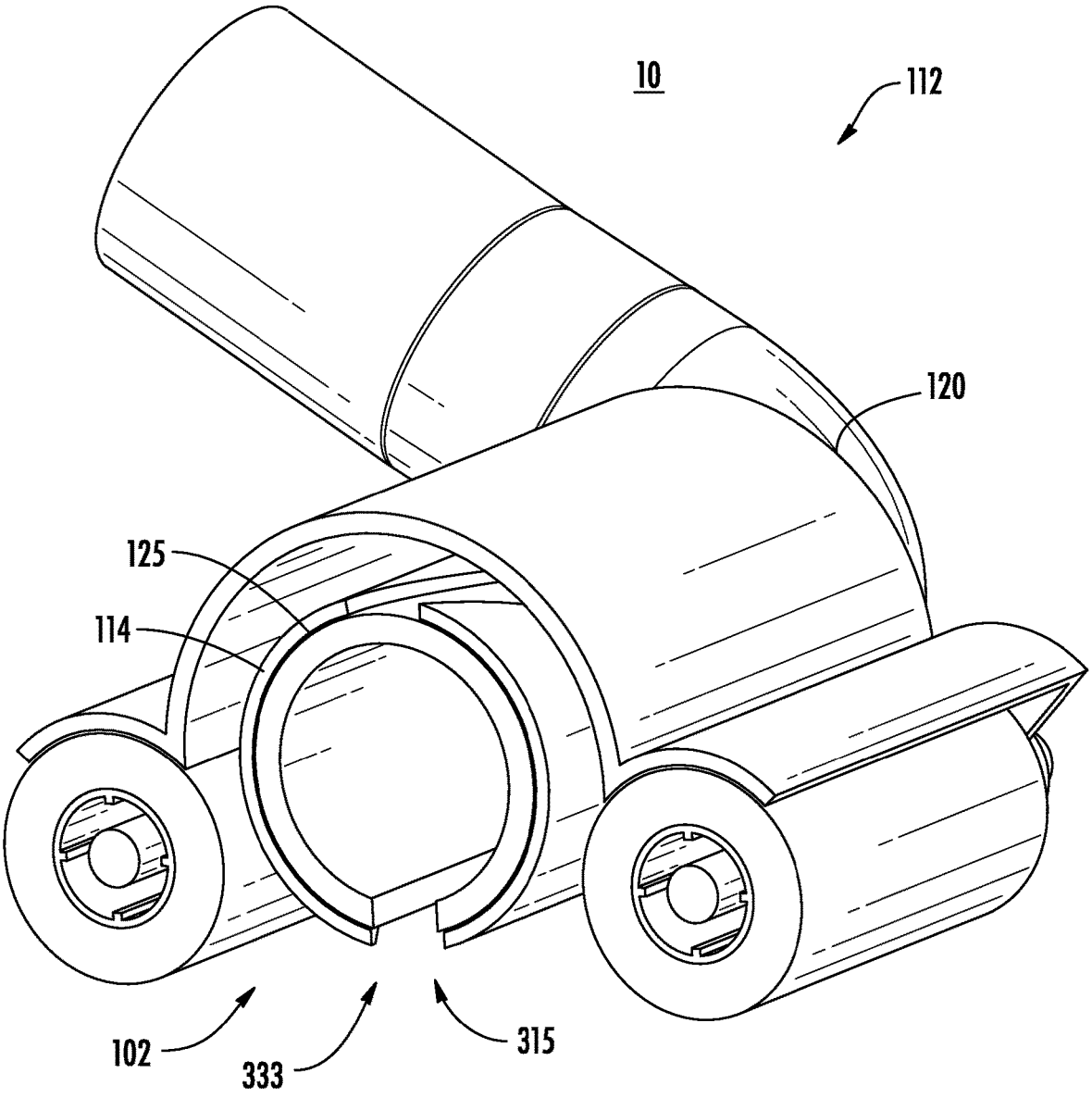
FIG. 5 shows a cross-sectional view of the agitator and nozzle assembly of FIG. 4 in which the suction tube inlet and the agitator suction inlet at least partially overlap at this position along the agitator.

In at least one embodiment, the agitator 114 rotates about the suction tube 125 such that there are one or more points (or one or more ranges of points) in the rotation of the agitator 114 about the pivot axis PA (and about the suction tube 125) where there is zero overlap of the suction tube inlet 315 and the agitator suction inlet 333, for example, as generally illustrated by the cross-sectional view in FIG. 4. In such an arrangement, the flow of air along the air path 313 may be generally stopped. As the agitator 114 continues to rotate about the pivot axis PA relative to the suction tube 125, the suction tube inlet 315 and the agitator suction inlet 333 will become aligned, and the flow of air along the air path 313 may be begin again, for example, as generally illustrated by the cross-sectional view in FIG. 5. As a result, the air flow along the air path 313 may start and stop to create a pulsing of the air flow. This pulsed air flow along the air path 313 may enhance the agitation debris along the surface 101 to be cleaned, thereby improving the efficiency of the vacuum 10.

Alternatively (or in addition), one or more of the suction tube inlets 315 and the agitator suction inlets 333 may be configured such that at least a portion of the inlets 315, 333 are always aligned as the agitator 114 rotates about the suction tube 125. As a result, a constant flow of air along the air path 313 may be created while the agitator 114 rotates about the pivot axis PA. This may be achieved, for example, using one or more helical agitator suction inlets 333 that extend circumferentially around the body 310 of the agitator 114.

As may be appreciated, alignment of the suction tube inlets 315 and the agitator suction inlets 333 may result in a focused air flow path is established as the agitator 114 rotates about the pivot axis PA. The focused air flow path may oscillate in a direction substantially parallel to the pivot axis PA as the agitator 114 rotates about the pivot axis PA.

The suction tube 125 may act as a support (e.g., an axle) for the agitator 114. Optionally, one or more support bearings 339 may be provided between the agitator 114 and the suction tube 125. In at least one aspect, the agitation motor 109 may be at least partially disposed within the suction tube chamber 325. According to at least one aspect, the agitation motor 109 may be at least partially disposed within the suction tube 125 disposed within the suction tube chamber 325 as generally illustrated in FIG. 3. For example, the agitation motor 109 may be secured to (e.g., removably secured to) the suction tube 125 and the agitator 114 may supported by and secured to (e.g., removably secured to) the agitation motor 109. One benefit to having the agitation motor 109 located within the suction tube 125 is that the air flow 313 may provide cooling for the agitation motor 109, thereby increasing the lifespan of the agitation motor 109 and/or reducing power consumption. Another benefit to having the agitation motor 109 located in the suction tube 125 is that it may reduce the overall size of the nozzle 112 and/or housing 120 since the space within the agitator 114 may otherwise be wasted. A further benefit to having the agitation motor 109 located in the suction tube 125 is that allows for one or more open ends 350 that can allow for debris (such as hair, fur, or the like) to be transported off the agitator 114 rather than remaining wrapped on the agitator 114 and/or on the agitator support (e.g., axle).

Figure 6:
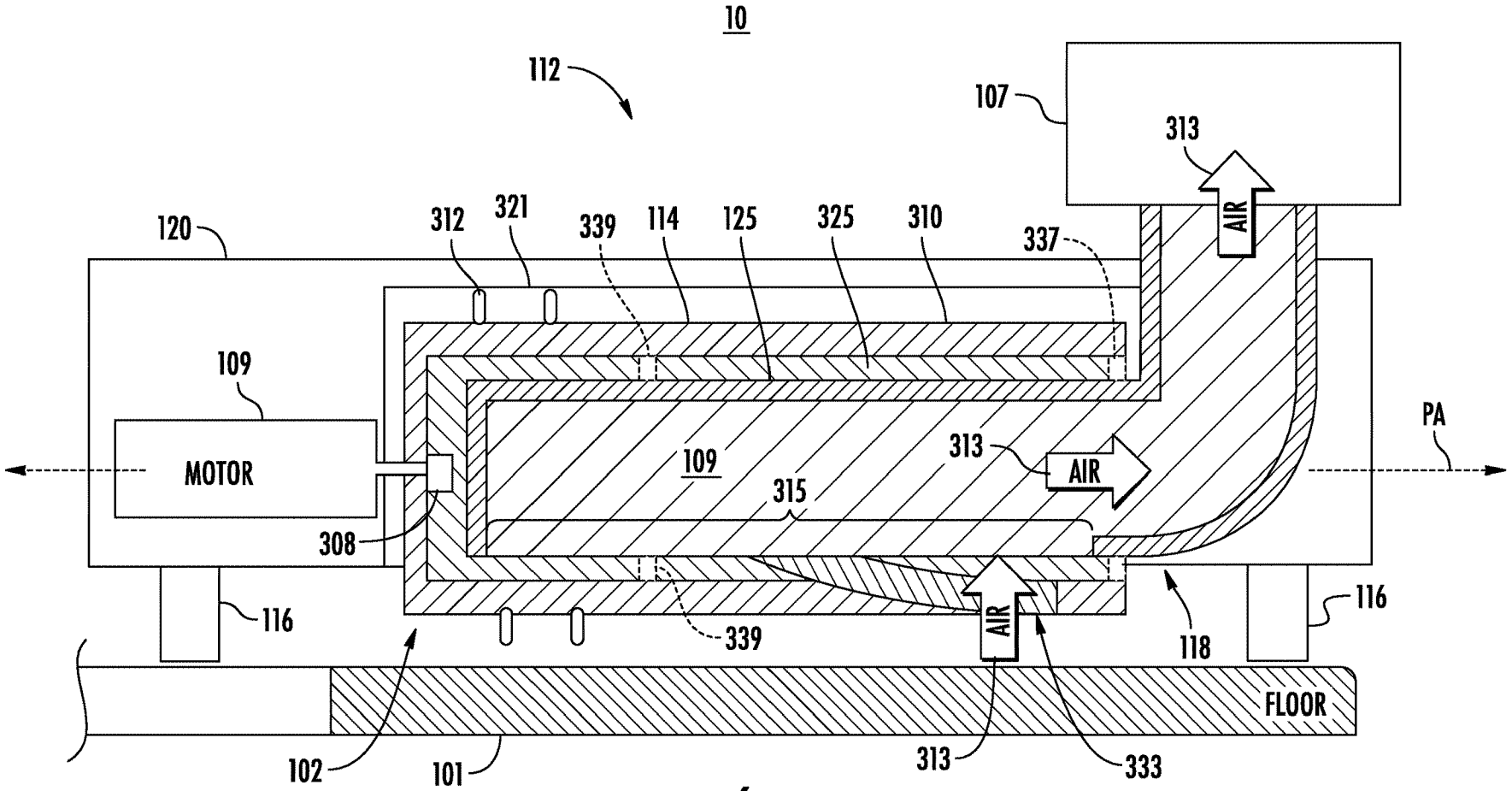
FIG. 6 shows a schematic view of another embodiment of the agitator and nozzle assembly of FIGS. 1 and 2 consistent with the present disclosure.

Alternatively (or in addition), the agitation motor 109 may be located external to the suction tube chamber 325. In particular, the agitation motor 109 may be located anywhere in and/or on the vacuum cleaner 10 such as, but not limited to, anywhere in and/or on the nozzle 112 and/or housing 120. In the illustrated embodiment of FIG. 6, the agitation motor 109 is shown located on the opposite side of the exit of the suction tube 125 (i.e. the side of the nozzle 112/housing 120 which is opposite to the side of the nozzle 112/housing 120 where the suction tube 125 exits the nozzle 112 and/or housing 120). It should be appreciated that the agitation motor 109 may be located above the suction tube 125, in front of the suction tube 125, behind the suction tube 125, on the same side as the exit of the suction tube 125, and/or anywhere else in/on the vacuum cleaner 10. It should also be appreciated that the drivetrain 308 may also be located anywhere in and/or on the vacuum cleaner 10.

Figure 7:
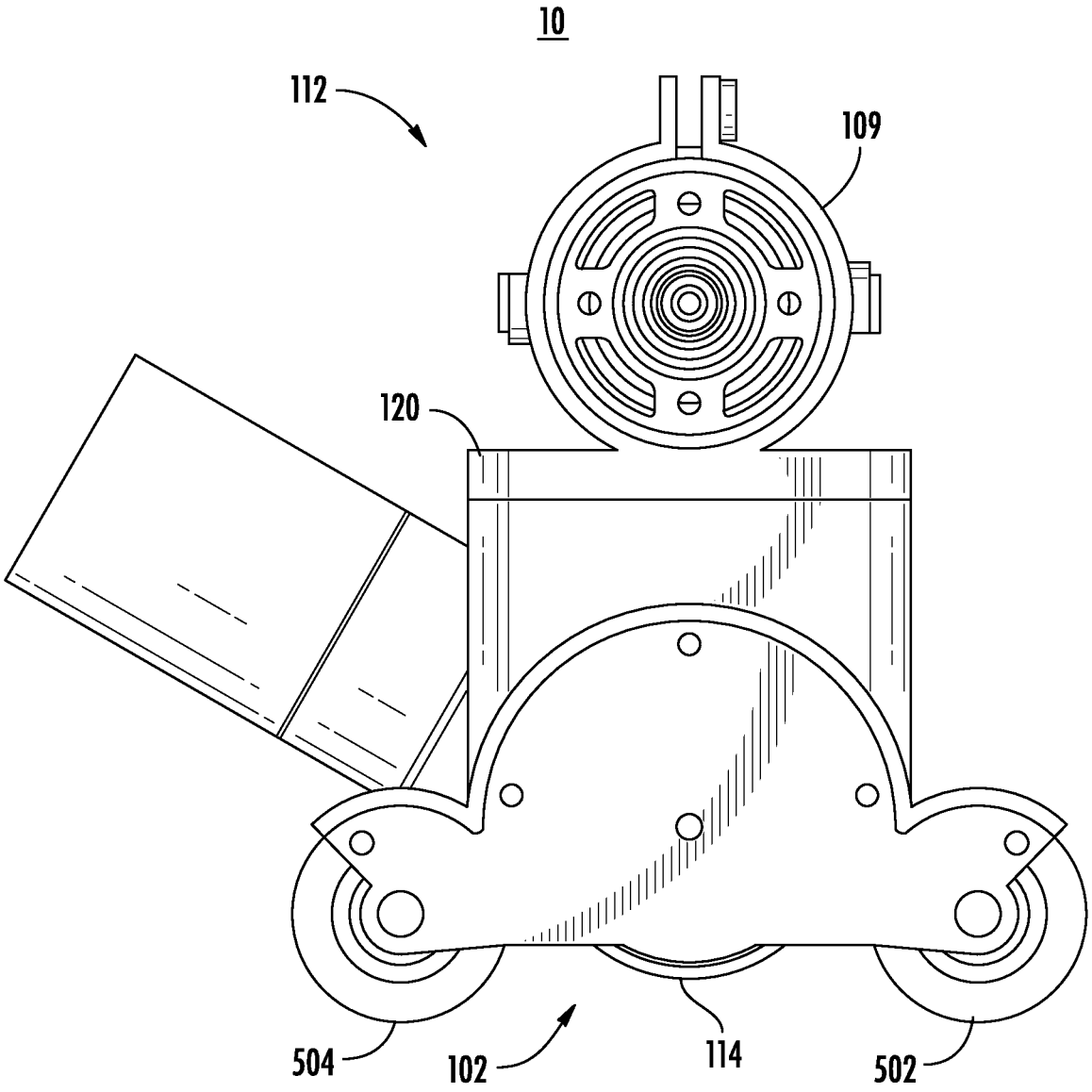
FIG. 7 shows a side view of a further embodiment of the agitator and nozzle assembly of FIGS. 1 and 2 consistent with the present disclosure.

Turning now to FIG. 7, one aspect of the present disclosure may include one or more additional agitators 502, 504. For example, one or more of the additional agitators (e.g., agitator 502) may be located in front of the agitator 114 and/or one or more of the additional agitators (e.g., agitator 504) may be located behind the agitator 114. The additional agitators 502, 504 may include soft rollers configured to rotate and help direct debris towards the agitator 114. The additional agitators 502, 504 may be a conventional agitator and/or may be an inverted agitator (i.e., may include a suction tube 125 disposed within a suction tube chamber 325 consistent with one or more aspects of the present disclosure). In the illustrated embodiment, the additional agitators 502, 504 extend below the agitator 114 (i.e., the additional agitators 502, 504 are closer to the floor 101 than the agitator 114); however, this is not a limitation of the present disclosure unless specifically claimed.

Figure 8:
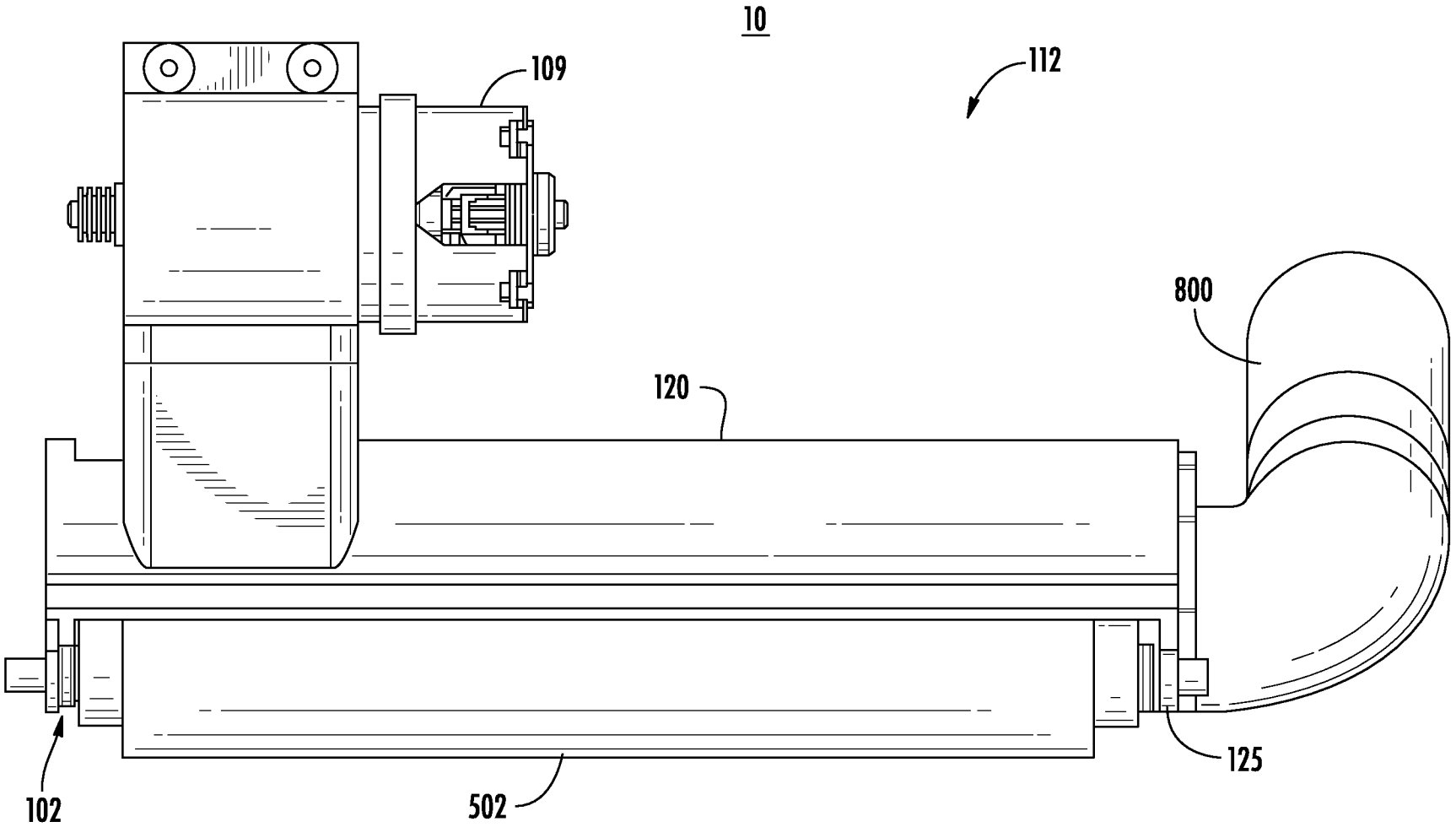
FIG. 8 shows a front view of an agitator and nozzle assembly including a movable outlet tube consistent with the present disclosure.

Optionally, an outlet tube 800, FIG. 8, may be coupled to the suction tube 125 and may move relative to the nozzle 112 and/or housing 120. For example, the outlet tube 800 may be pivotally coupled to the suction tube 125. According to one embodiment, the outlet tube 800 may extend from the nozzle 112, and may allow the nozzle 112 to move relative to the rest of the vacuum 10 (e.g., allow the nozzle 112 to move relative to a wand 108 and/or handle 110 (FIG. 1).

Figure 9:
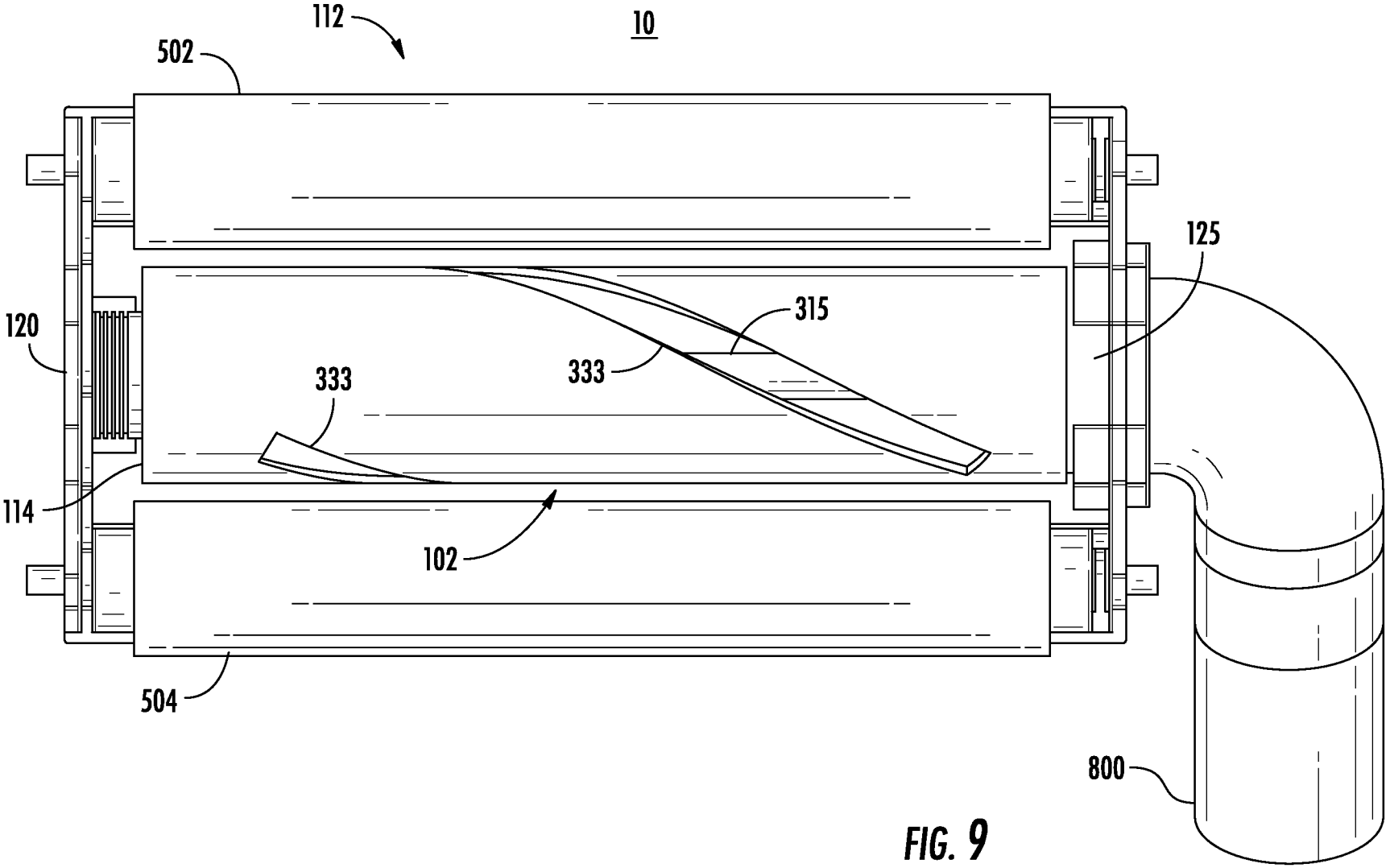
FIG. 9 shows a bottom view of an additional embodiment of the agitator and nozzle assembly of FIGS. 1 and 2 consistent with the present disclosure.

With reference to FIG. 9, one example of an agitator and nozzle assembly 102 including an agitator 114 having a plurality of agitator suction inlets 333 is generally illustrated. As shown, the agitator suction inlets 333 have a helical shape, but could have linear configuration. The inclusion of two or more agitator suction inlets 333 may provide for smoother operation. Additionally, while the illustrated embodiment shows only one agitator suction inlet 333 aligned with the suction tube inlet 315, it should be appreciated that two or more agitator suction inlets 333 may be aligned with the suction tube inlet 315 simultaneously.

Figure 10:
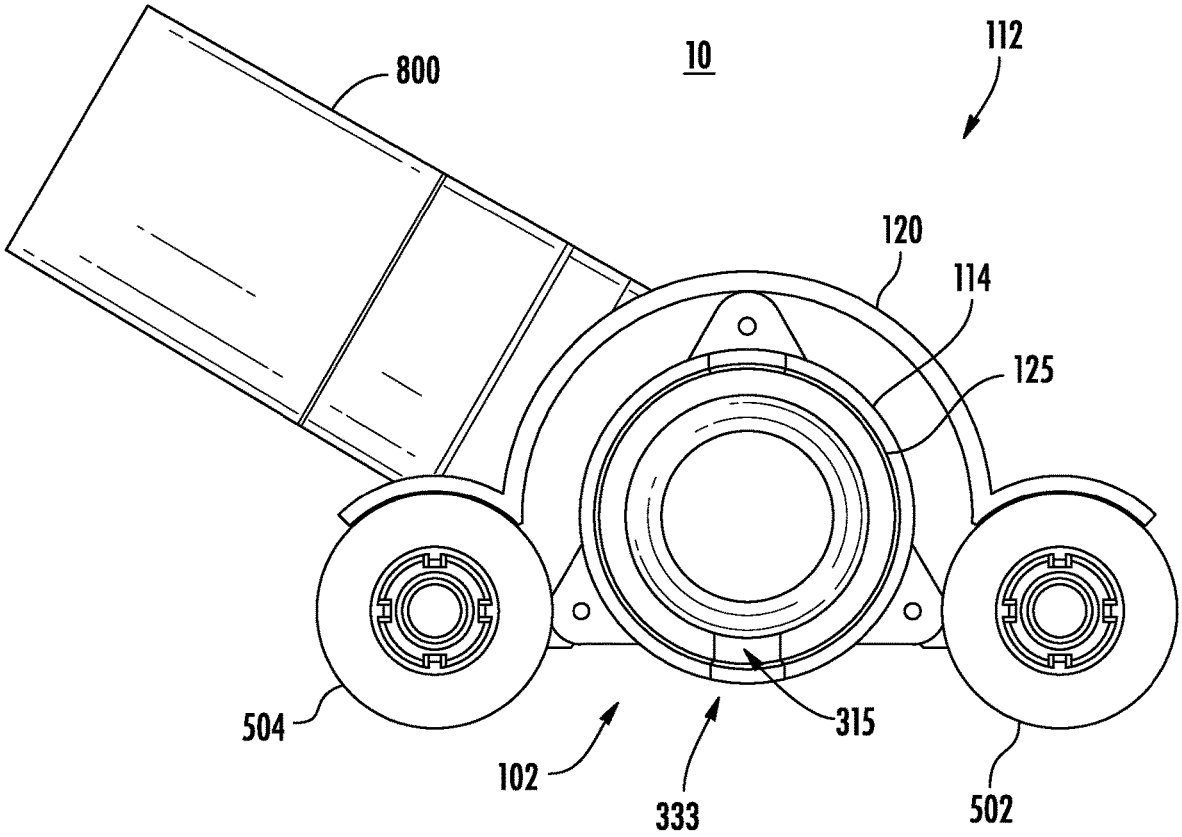
FIG. 10 shows a cross-sectional view of a further embodiment of the agitator and nozzle assembly of FIGS. 1 and 2 consistent with the present disclosure.

Turning now to FIG. 10, according to at least one aspect of the present disclosure, the internal dimension (e.g., diameter) of the agitator 114 (i.e., the internal dimension of the suction tube chamber 325) may be slightly larger than the outer dimension (e.g., diameter) of the suction tube 125. For example, the internal dimension (e.g., diameter) of the agitator 114 (i.e., the internal dimension of the suction tube chamber 325) may be up to 20% larger than the outer dimension (e.g., diameter) of the suction tube 125, up to 15% larger than the outer dimension (e.g., diameter) of the suction tube 125, up to 10% larger than the outer dimension (e.g., diameter) of the suction tube 125, up to 5% larger than the outer dimension (e.g., diameter) of the suction tube 125, and/or up to 3% larger than the outer dimension (e.g., diameter) of the suction tube 125, including all ranges and values therein.

Figure 11:
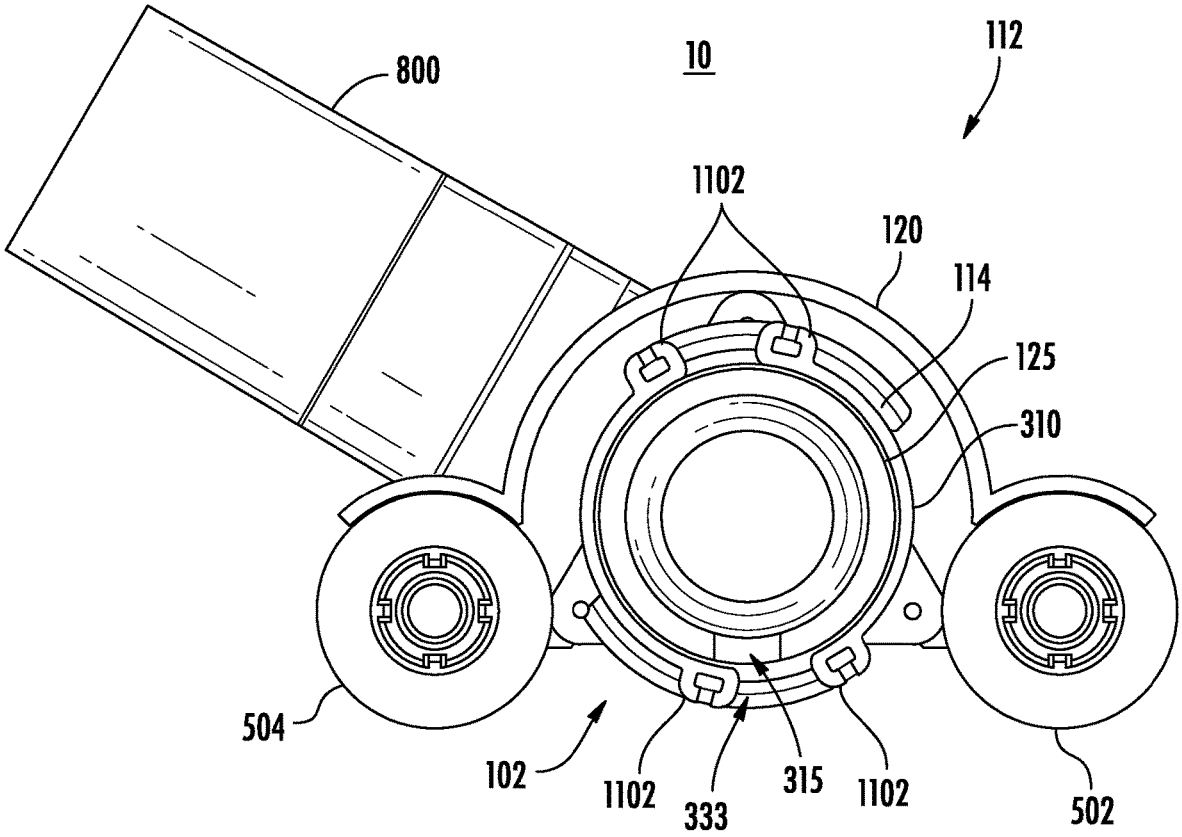
FIG. 11 shows a cross-sectional view of an additional embodiment of the agitator and nozzle assembly of FIGS. 1 and 2 consistent with the present disclosure.
Figure 12:
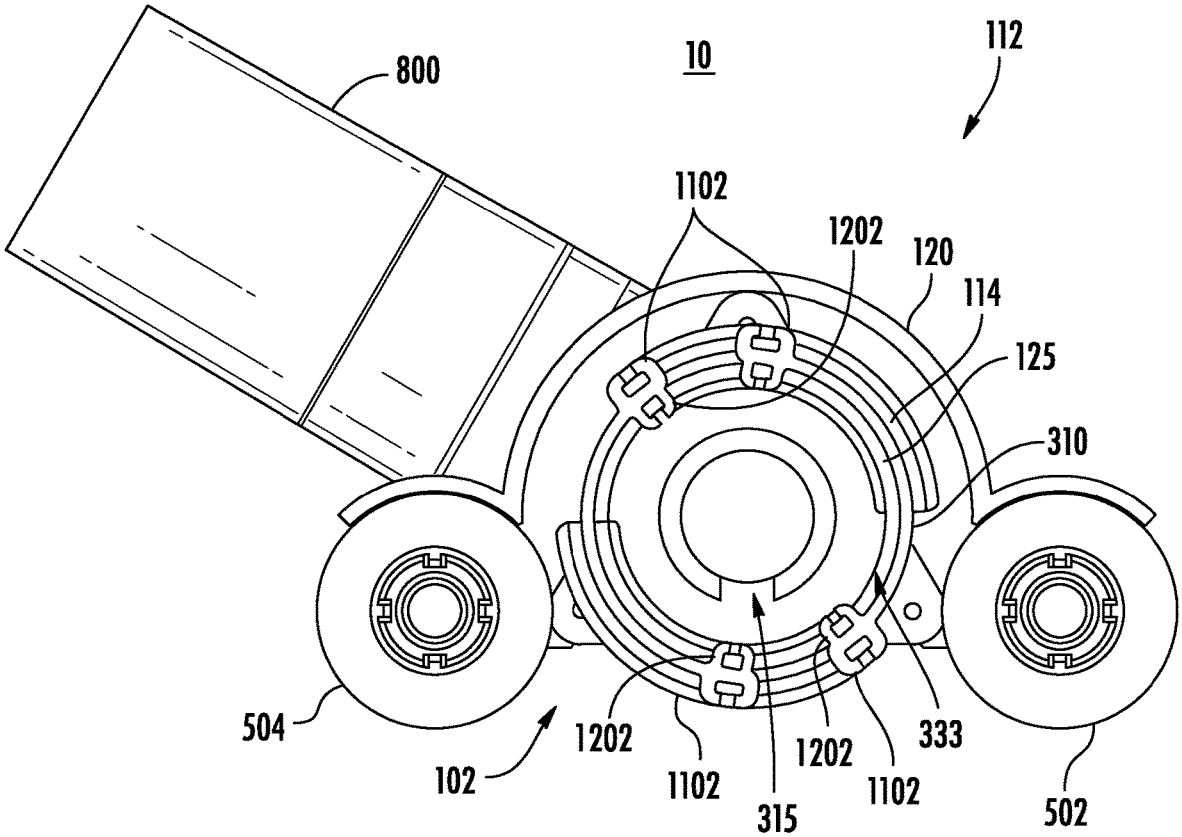
FIG. 12 shows a cross-sectional view of yet another embodiment of the agitator and nozzle assembly of FIGS. 1 and 2 consistent with the present disclosure.

The agitator 114 (e.g., the agitator body 310) may optionally include one or more slots and/or grooves 1102 disposed on the outer surface of the agitator 114 as generally illustrated in FIG. 11. The slots and/or grooves 1102 may be configured to accept bristles (e.g., a row of bristles) and/or blades. The agitator 114 (e.g., the agitator body 310) may additionally optionally include one or more slots and/or grooves 1202 disposed on the inner surface of the agitator 114 as generally illustrated in FIG. 12. The slots and/or grooves 1202 may be configured to accept bristles (e.g., a row of bristles) and/or blades. According to this embodiment, the internal dimension (e.g., diameter) of the agitator 114 (i.e., the internal dimension of the suction tube chamber 325) may be large enough to allow the internal bristles and/or blades (not shown for clarity) to move within suction tube chamber 325. The internal bristles and/or blades may aid in directing debris into the suction tube inlets 315. According to one aspect, the internal bristles and/or blades may be configured to contact the outer surface of the suction tube 125; however, it should be appreciated that the internal bristles and/or blades may not contact the outer surface of the suction tube 125.

Figure 13:
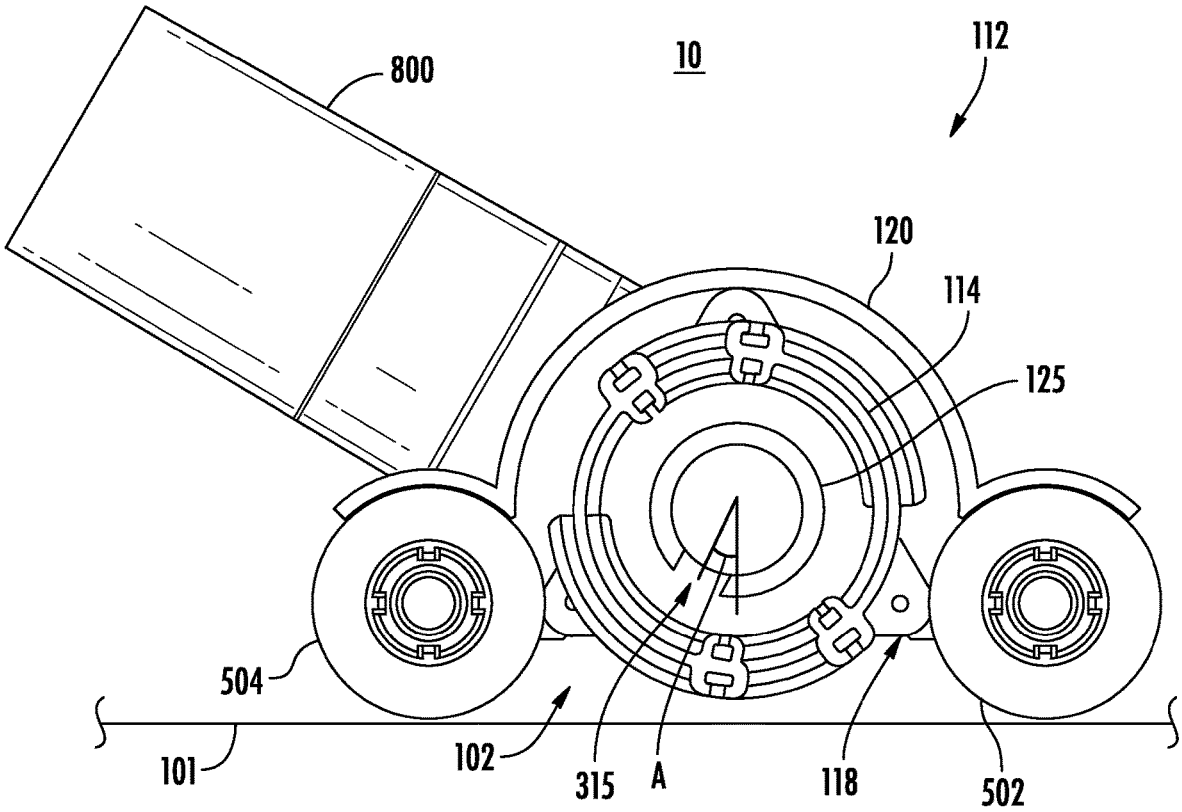
FIG. 13 shows a cross-sectional view of yet a further embodiment of the agitator and nozzle assembly of FIGS. 1 and 2 consistent with the present disclosure.

Turning now to FIG. 13, one example of an agitator and nozzle assembly 102 having a suction tube inlet 315 which is disposed at a non-perpendicular angle A relative to the floor 101 and/or bottom surface 118 of the nozzle 112/housing 120 is generally illustrated. As noted herein, the angle A may be within the range of +/−70 degrees from normal to the floor 101 and/or bottom surface 118 (i.e., within the range of 20 degrees to 160 degrees from the floor 101 and/or bottom surface 118) generally in the direction of the forward and backward movement of the vacuum (i.e., generally traverse to the pivot axis PA).

Figure 14:
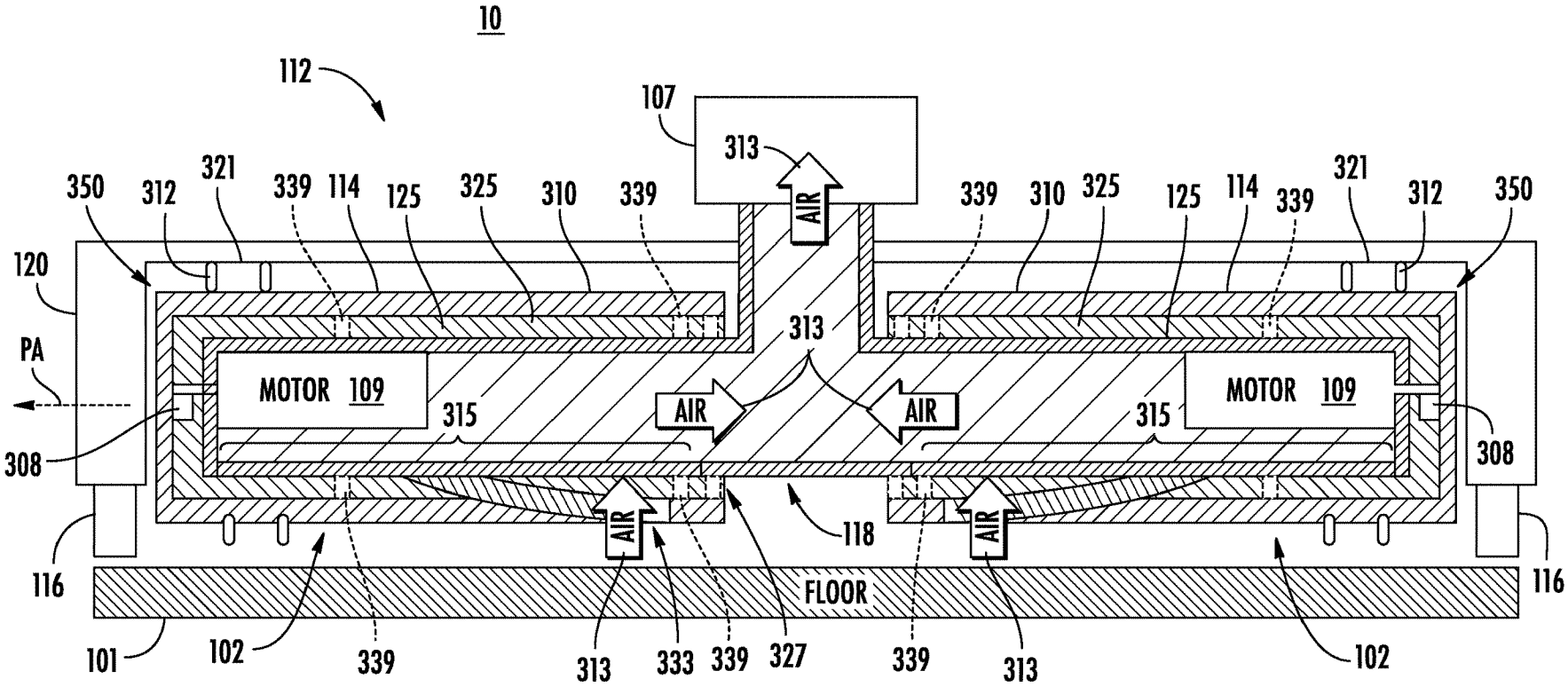
FIG. 14 shows a cross-sectional view of an additional embodiment of the agitator and nozzle assembly of FIGS. 1 and 2 consistent with the present disclosure.

With reference to FIG. 14, one example of an agitator and nozzle assembly 102 of a vacuum cleaner 10 consistent with the present disclosure is generally illustrated with multiple agitators 114 fluidly coupled to a suction tube 125. For example, the agitator and nozzle assembly 102 may be considered to have a split agitator 114 with a suction tube 125 disposed between the portions of the split agitator 114 (e.g., but not limited to, in the middle or center of the portions of the split agitator 114).

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaner system comprising:

an agitator and nozzle assembly comprising:

an agitator configured to rotate about a pivot axis, said agitator including agitator body having one or more agitator suction inlets and further defining at least one suction tube chamber, said suction tube chamber extending along at least a portion of said pivot axis and including a suction tube opening disposed at one end thereof; and a suction tube configured to be received through said suction tube opening and at least partially into said suction tube chamber, said suction tube comprising at least one suction tube inlet;

wherein said agitator is configured to rotate about said pivot axis relative to said suction tube such that an air flow path is established which extends through said one or more agitator suction inlets, into said suction tube chamber, through said suction tube inlet, and into said suction tube; and wherein said one or more agitator suction inlets includes one or more curvilinear slots configured such that a portion of said one or more agitator suction inlets is substantially always in fluid communication with said suction tube inlet as said agitator rotates about said pivot axis to establish a focused air flow path which oscillates in a direction substantially parallel to said pivot axis.

2. The vacuum cleaner system of claim 1, wherein said agitator further comprises at least one agitating feature extending outward from an external surface of said agitator body.

3. The vacuum cleaner system of claim 1, further comprising an agitator motor.

4. The vacuum cleaner system of claim 3, wherein said agitator motor is at least partially disposed within said suction tube.

5. The vacuum cleaner system of claim 1, wherein said agitator is at least partially supported by said suction tube as said agitator rotates about said pivot axis.

6. The vacuum cleaner system of claim 1, wherein at least one of said one or more curvilinear slots extends from a first end of said agitator to a second, opposite end of said agitator.

7. The vacuum cleaner system of claim 1, wherein said one or more curvilinear slots includes at least one generally helical slot.

8. The vacuum cleaner system of claim 1, wherein said suction tube inlet is faces towards a bottom surface of said vacuum cleaner system.

9. The vacuum cleaner system of claim 1, wherein said vacuum cleaner system comprises a robotic vacuum cleaner.

10. The vacuum cleaner system of claim 1, wherein said vacuum cleaner system comprises a hand-operated vacuum cleaner.

11. The vacuum cleaner system of claim 1, further comprising a seal between an inner surface of said suction tube chamber and an outer surface of said suction tube.

12. The vacuum cleaner system of claim 1, wherein an internal dimension of said suction tube chamber is up to 20% larger than an outer dimension of said suction tube.

13. The vacuum cleaner system of claim 1, wherein said suction tube inlet forms an elongated slot having a length extending generally along said pivot axis PA which is greater than or equal to 20% of a length of the agitator.

14. The vacuum cleaner system of claim 1, wherein said at least one agitator suction inlets includes two or more agitator suction inlets.

15. The vacuum cleaner system of claim 1, wherein said agitator and nozzle assembly is disposed within a nozzle, said nozzle having a bottom surface and at least a portion of said agitator extending below said bottom surface, wherein said suction tube opening extends generally perpendicular to said bottom surface.

16. The vacuum cleaner system of claim 1, wherein said agitator and nozzle assembly is disposed within a nozzle, said nozzle having a bottom surface and at least a portion of said agitator extending below said bottom surface, wherein said suction tube opening extends at an angle within the range of +/−70 degrees from normal to said bottom surface.

17. A vacuum cleaner system comprising:

an agitator and nozzle assembly comprising:

an agitator configured to rotate about a pivot axis, said agitator including agitator body having one or more agitator suction inlets; and a suction tube configured to be fluidly coupled to said agitator, wherein said one or more agitator suction inlets includes one or more curvilinear slots extending from a first end of said agitator to a second, opposite end of said agitator, said one or more curvilinear slots configured to substantially always be in fluid communication with said suction tube as said agitator rotates about said pivot axis such that a focused air flow path is established which oscillates in a direction substantially parallel to said pivot axis.

* * * * *